US005201426A

United States Patent [19]

Cruwell, Jr.

[11] Patent Number: 5,201,426

[45] Date of Patent: Apr. 13, 1993

[54] SHOPPING CART CORRAL

[76] Inventor: Ernest A. Cruwell, Jr., 16875 E. US 40 Hwy., Independencce, Mo. 64055

[21] Appl. No.: 731,122

[22] Filed: Jul. 15, 1991

[51] Int. Cl.[5] ..... A47F 5/00

[52] U.S. Cl. ..... 211/17; 211/195

[58] Field of Search ..... 211/17, 13, 195, 199; 280/33.991, 33.992; 186/62

[56] References Cited

U.S. PATENT DOCUMENTS

| | | | |
|---|---|---|---|
| 4,354,604 | 10/1982 | Isaacs | 211/17 |
| 4,450,968 | 5/1984 | Muellner | 211/17 |
| 4,726,602 | 2/1988 | Sanders et al. | 211/195 X |
| 4,952,118 | 8/1990 | MacMillan | 211/13 X |

*Primary Examiner*—Robert W. Gibson, Jr.

*Attorney, Agent, or Firm*—Thomas M. Scofield

[57] ABSTRACT

Improvements in shopping cart corrals of the type used in parking lots of supermarket stores; provision of an improved shopping cart corral construction which is alternatively (a) pivotable at certain joints thereof and foldable upon itself for storage and transportation and (b), on the other hand, lockable in rigid structural position for use in a supermarket parking lot; in shopping cart corrals typically having one closed and one open end with elongate fence portions enclosing the space between the two ends, the provision of mounting means for the elongate fence portions on the closed end portion which permit both (a) pivoting and folding of the elements of the device upon itself for storage and transport and (b) locking of the sides and ends of the device rigidly with respect to one another for use.

10 Claims, 2 Drawing Sheets

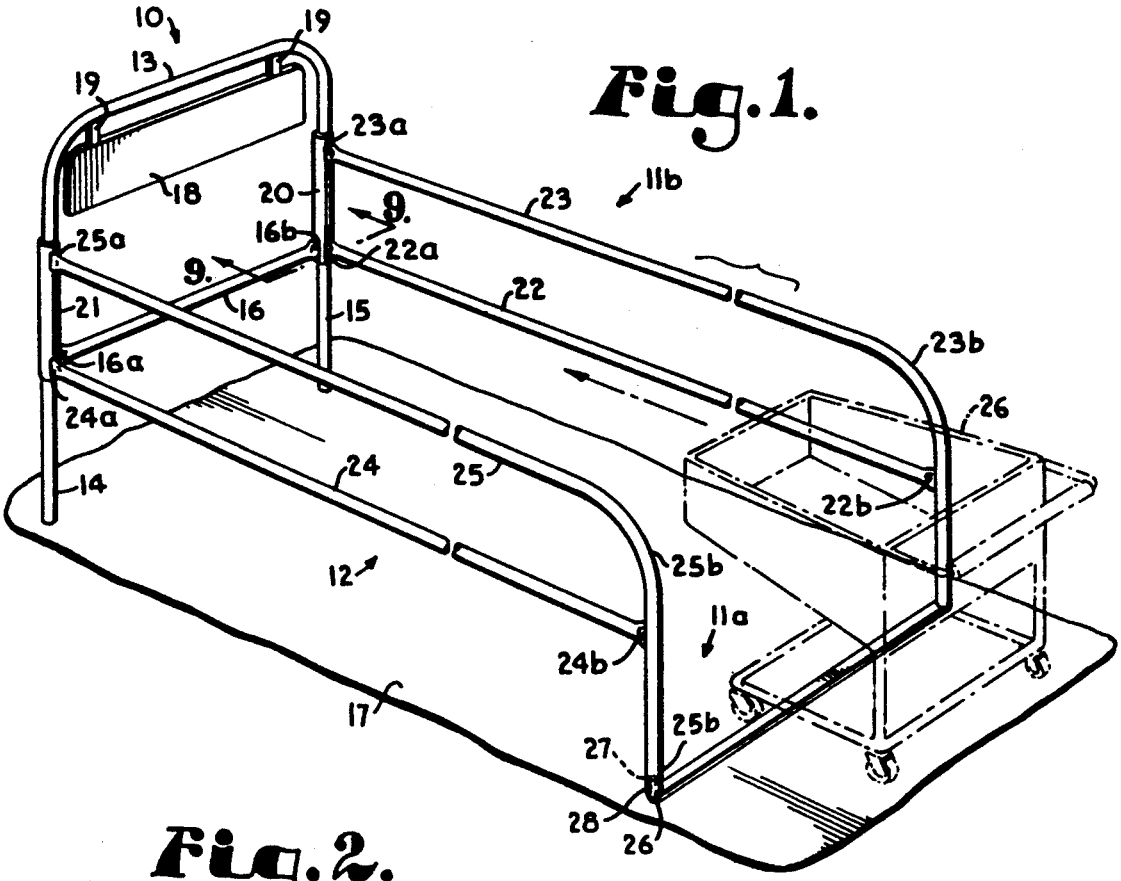
Fig. 1.
Fig. 2.
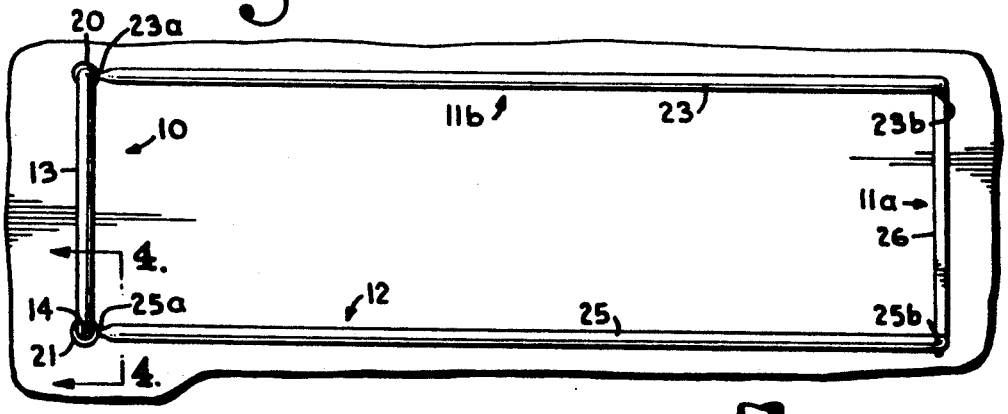
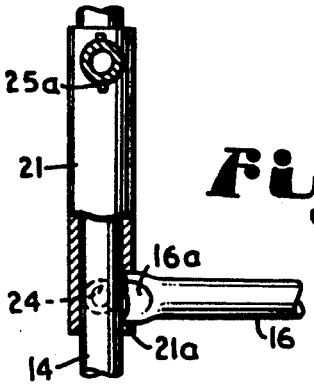
Fig. 4.
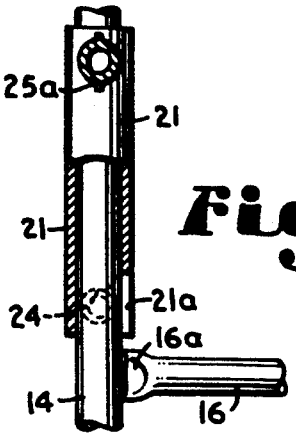
Fig. 6.

SHOPPING CART CORRAL

BACKGROUND OF THE INVENTION

Shopping cart corrals are devices that are extremely well known in the marketplace, in wide use in supermarket parking lots and in the prior art. With the growth of supermarket trading and shopping in the United States, also came the great growth of the use of voluminous shopping carts by shoppers to enable large quantities of products, goods and purchases to be conveniently carried from the shelves of the supermarket through the cashier of the supermarket to the car of the purchaser in the parking lot of the supermarket. In order to prevent blocking of the parking lot parking spaces by abandoned shopping carts, the typical shopping cart corrals were developed and are provided, spaced at intervals through the parking lot, of the supermarket or store.

In these corrals, the shopping carts are placed by the purchasers at the store and/or employees of the store, the shopping carts interengaging and interpenetrating one another for space saving reasons. Periodically store personnel retrieve the collections of shopping carts from the corrals and return them to the pickup places in the store where the shoppers take them.

Because of the construction of the shopping carts, which are almost universally the same and, as mentioned, longitudinally engage with one another as they are collected together, the typical shopping cart corral is made up of a typically "closed" (or closeable) end which is also typically but not necessarily taller than the opposite open (or openable) end noted. The closed end typically is an inverted U-member (configured metal pipe) which may or may not have a floor piece connecting the lower ends thereof. The cart receiving space in the corral is defined by a pair of parellel sets of vertically spaced apart, horizontal beams, spaced apart a distance somewhat greater than the width of the shopping carts. One end of each set of parallel beams or members is typically rigidly fixed or welded to the vertical legs of the "closed" end member. The other, spaced away ends of the paired, vertically spaced apart rods, arms or beams typically are connected to or form vertical legs closing the free or open ends of the beam sets. These typically shorter legs (compared to the height of the U inverted member of the other end) support the two sets of beams in parallel, spaced apart array. There may be a ground member or base member connecting the bottom ends of the short legs at the open end of the corral.

One or more bars may be provided across the closed end for the purpose of holding or stopping the carts therewithin. (Question: Is this true of any standard corrals or just us? ) These members typically would be parallel and would be horizontal and positioned at a height lower than the tops of the carts at the lowest end thereof. Such beams may be bolted or welded to the inverted U-member of the "closed" end. Alternatively, at the corral closed end, there may be provided a chain member which has the purpose of holding the carts in place. Optionally there may be provided a chain member at the open end so that the carts can be fed from the other direction. If there is a chain at one or both ends of the corral, the chain is typically removable at one or both ends.

Typically, the prior art shopping cart corrals, once such are installed in the parking lot of a given supermarket, are rigidly fixed and remain there. They may have to be repaired or re-welded if there is car impact damage, vandalism or the like. If the supermarket is sold or goes out of business there may be changes. If the parking lot is to be cleared, the corrals are merely torn down or torched apart. (Question: Is this true? ) In change of ownership, one type of shopping cart corral may be exchanged for another more preferred by the new owner.

THE PRIOR ART

Applicant has catalog sheets of three different manufacturers' corrals, sheets A, B, and C each of the type generally described in the previous section of this Application. On one sheet there is also shown a symmetrical device with two shorter inverted U-members, this latter device having great structural strength and rigidity. Typical shopping cart corrals will hold twelve large shopping carts condensed into one another. Typical dimensions would be: for the length of the corral, comprising the length of the paired horizontal sets of beams 120 inches, for the width of the corral, the distance the horizontal beam members are spaced apart and the vertical members of the end U-member are spaced apart, 65 inches, for the height of a typical vertical closed end inverted U-member, 62 inches.

For reference in Prior Art consideration, page A has models 72002 and 72003 thereon. Page B shows a perspective of model 108-3. Page C shows a perspective of the 105 series or 105-1 shopping cart corral.

OBJECTS OF THE INVENTION

A first object of the invention is to provide substantial and useful improvements in the basic structure and function of shopping cart corrals for use in super market parking lots.

Another object of the invention is to provide a new shopping cart corral having advantageous new features, uses and functions.

Another object of the invention is to provide a shopping cart corral of extremely strong and rigid construction when positioned for use in a parking lot, such also having the feature of being foldable and collapsable upon itself, whereby to minimize the space taken up by the corral in storage thereof and, additionally, transport thereof.

Yet another object of the invention is to provide an improved, integral yet collapsable shopping cart corral construction wherein the means for locking the elements of the corral in the necessary right-angled C-plan structure, as well as permitting folding and collapsing of the construction on itself, are exceedingly simple in structure yet strong and versatile in facilitating all of the functions necessary to provide the subject improved shopping cart corral.

Other and further objects of the invention will appear in the course of the following description thereof.

THE DRAWINGS

In the drawings, which form a part of the instant specification and are to be read in conjunction therewith, an embodiment of the invention is shown and, in the various views, like numerals are employed to indicate like parts.

FIG. 1 is a three-quarter perspective view from above, as well as from the inlet end of the cart corral, showing the subject inventive corral construction in use position.

FIG. 2 is a top view of the shopping cart corral of FIG. 1.

FIG. 4 is a view taken along the line 4—4 of FIG. 2 in the direction of the arrows, the lower portion of the sleeve being cut away to better show the interengagement of the parts of the device when working or operating position.

FIG. 6 is a view like that of FIG. 4, but with the sleeve raised out of engagement with the end closure horizontal beam (the functionally opposite position from that of FIG. 4).

Figure 8:
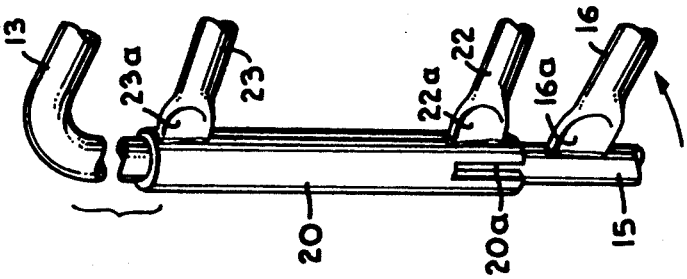
Figure 3:
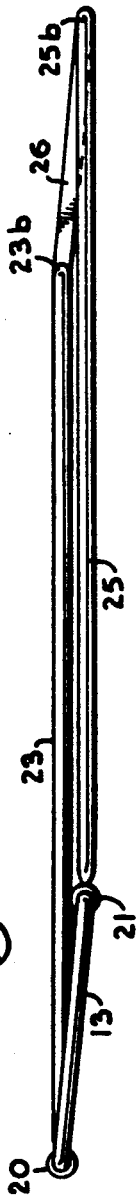
FIG. 3 is a top view of the subject shopping corral collapsed upon itself, as opposed to the view of FIG. 2 showing the device in active use position.
Figure 7:
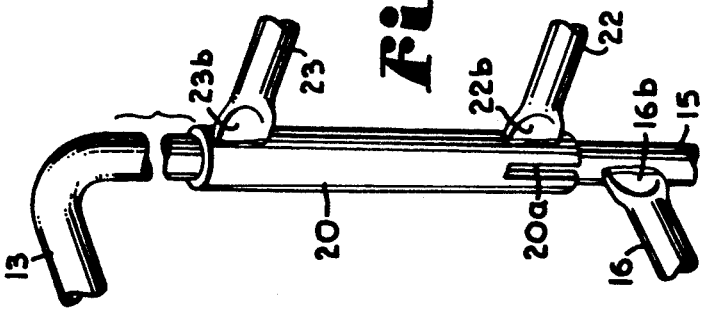
FIG. 7 is a view like that of FIG. 5, but showing the sleeve raised upwardly to enable the device to be folded upon itself for transport. This is the left hand end of FIG. 3 before the pivoting of the parts of FIG. 3 into the position of FIG. 3.
Figure 5:
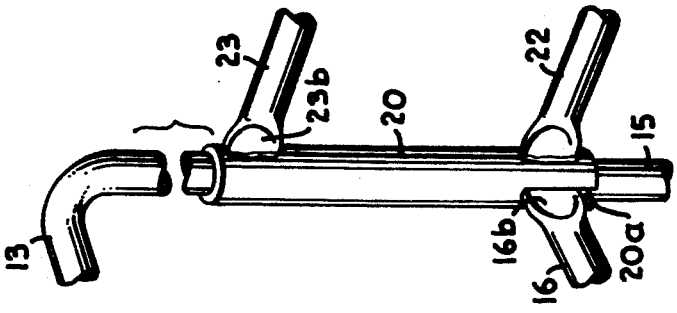
FIG. 5 is a fragmentary three-quarter perspective view from above of the upper left hand (left center) beam and sleeve engagement of FIG. 1 in working or use position (locked).

FIG. 8 is a view like those of FIGS. 5 and 7 (looking at the engagement the area 9—9 of FIG. 1), but differing from FIG. 7 in that the rear wall section has been moved in a counter-clockwise direction from the position of FIG. 7 to the position of FIG. 8, approximately 90 degrees, to reach the position seen at the left hand end of FIG. 3.

Figure 9:
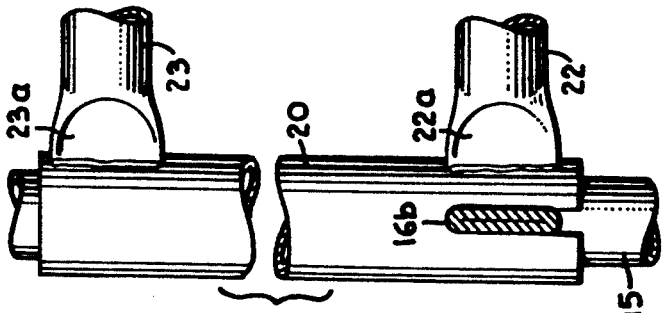

FIG. 9 is a view taken along the line 9—9 of FIG. 1 and the direction the arrows.

STRUCTURE AND FUNCTION

Referring to the drawings, at 10 is generally designated the closed end of this particular shopping cart corral. At 11 is the open end thereof. FIGS. 1 and 2 show the device in use position with the closed end 10 opposed directly to the open end 11 and the confining sidewall portions (generally designated 11 and 12) running parallel to one another and at right angles to the structurals making up the closed end.

Closed end 10 is defined by an inverted U-shaped member having a typically horizontal upper end 13 and typically vertical side members, beams or legs 14 and 15. There is additionally provided a horizontal beam member 16 rigidly fixed at its ends 16*a* and 16*b* to vertical legs 14 and 15 and spaced upwardly from the ground level 17. A sign 18 may be mounted on top beam 13 of the closed end of the corral by members 19.

A pair of hollow slides or sleeves 20 and 21 are slideably received or mounted on vertical legs 14 and 15 of the closed end 10 of the corral. They are each mounted above horizontal cross beam 16. A first set 22 and 23 of elongate, horizontal rods, bars or beams 22 and 23 are rigidly connected or welded at one end thereof 22*a* and 23*a* to slide or sleeve 20 adjacent the upper and lower ends thereof, preferably. At the opposite ends of beams 22 and 23, they are joined together by downwardly curved portion 23*b* of beam 23, there being a connection 22*b* of beam 22 with downwardly curved and vertically extending beam portion 23*b*.

On the opposite side of the corral, there are provided opposed, parallel, horizontal rods or beams 24 and 25 like beams and 23. Beams 24 and 25 are connected to sleeve 21 on leg 14 adjacent the upper and lower portions thereof by ends 24*a* and 25*a*. Analogous to or the same as the opposing beams 22 and 23, downwardly curved and vertically extending upper beam end 25*b* operates to connect beams 24 and 25 as at 24*b* and support the inlet or input end of the corral. A standard shopping cart is shown in dotted lines at 26 to the right in FIG. 1.

What is desired and needed in the shopping cart corral construction previously described and being described is the ability to collapse the structure upon itself, flat, while keeping the structure integral, so as to be able to readily reconstitute same to the open operating configuration seen in FIGS. 1 and 2. It is the sleeves 20 and 21 on legs 14 and 15 of the closed end 10, such connected to the sets of horizontal beams 22–23, 24–25 that permit this, with interaction and cooperation thereof with cross member 16 of the closed end, as will be shown and described.

The detailed construction of the sleeves 20 and 21 and their interaction with the ends of horizontal beam 16 at 16*a* and 16*b* where same connects to vertical members 14 and 15 will now be described. It should particularly be noted that FIGS. 4 and 6 are directed to showing engagement and disengagement of sleeve 21 on vertical beam 14 with end 16*a* of beam 16, FIG. 4 showing engagement in the corral use position of FIGS. 1 and 2 and FIG. 6 showing disengagement preparatory to departing from the use position of those figures.

FIGS. 5–9, inclusive are directed to showing the same structure and action (engaging and disengaging a slide 20 or 21 with one end of beam 16), but all of the structure and action is shown with respect to the opposite leg 15 and sleeve 20 in the portion of the drawing in FIG. 1 having the section line 9—9 thereat. Accordingly, when the slides and their engagement and disengagement with the ends of beams 16 are referred to, reference may be made to either slide 21 with respect to FIGS. 4 and 6 and vertical number 14 as well as end 16*a* of beam 16, or, alternatively, to the contrary, vertical member 15 with slide 20 thereon and end 16*b* of beam 16.

Referring, then, to FIGS. 4 and 6, a slot 21*a* is formed in the lower wall of sleeve 21 at a position at right angles to horizontal beams 24 and 25, whereby such slot 21*a* may engage and disengage flattened portion 16*a* of beam 16 next to vertical leg 14 to which member 16 is attached. The engagement, seen in FIG. 4 and FIG. 1, fixes sleeve 21 rotationally with respect to leg 14 and beam 16 so that horizontal beams 24 and 25 extend rigidly normal to beam 16 and beam 13. By grasping one or both of beams 24 and 25 adjacent ends 24*a* and 25*a*, the sleeve 21 may be lifted from the engagement position of FIG. 4 to the disengagement position of FIG. 6. It should be understood that once the shopping cart corral is fixed in use position as seen in position in FIGS. 1 and 2, the engagement/disengagement just described does not take place. Thus, a hole (not seen) is provided in sleeves 21 and 20 so that, once the device is positioned as in FIG. 1 and the engagements of FIG. 4 and FIG. 5 are effected, the sleeves are pop riveted to vertical beams 14 and 15. In use, the shopping cart corral is fixed in place in the parking lot of a supermarket in conventional fashion.

Now looking at FIGS. 5–9, sleeve 20 has slot 20*a* in the lower end thereof adapted to engage and disengage flattened portion 16*b* of beam 16. FIG. 5 shows a fragmentary view of the corner of the corral seen in the upper left center of FIG. 1 with sleeve 20 on vertical beam 15 engaging beam 16 at 16*b*, thus holding horizontal beam 22 and 23 rigidly at right angles or normal to beams 16 and 13 and parallel to beams 24 and 25.

FIG. 7 is strictly comparable to FIG. 6 in that the respective sleeve 20/21 has been raised clear of its engagement 16*b*/16*a* by gripping one or more of beams 22 or 23 adjacent ends 22*a* and 23*a* thereof and lifting same.

It should be noted that the pivoting and folding may be done from either corner 14 or 15 of the closed end of the corral. What is shown in this particular set of drawings is that the end member or closure (14, 15, 16, and 13) is pivoted counter clockwise in the view of FIGS. 1 and 2 so as to fold down against the horizontal beams 22 and 23 as may be seen in FIG. 3.

To make the complete fold or collapse of the members to the position of FIG. 3, of course, the sleeves or slides 20 and 21 both must be disengaged from their engagement with member 16 so that vertical beam 15 may pivot counter clockwise in sleeve 20 and vertical beam 14 pivot counter clockwise in sleeve 21.

FIG. 8 is a detail of the fully pivoted member 15 in sleeve 20.

The opposite type of fold or collapse of the horizontal beam sets 22/23 and 24/25 on one another may be accomplished simply by, when two sleeves 20 and 21 have been disengaged as in FIG. 6 and FIG. 7, vertical beam 14 is pivoted clockwise in sleeve 21 and vertical beam 15 is pivoted clockwise in sleeve 20. This is accomplished by pushing beams 24 and 25 and vertical 14 to the left in FIGS. 1 and 2 or moving beams 22 and 23 to the right in FIGS. 1 and 2 or both.

Thus it is seen that an integral shopping corral has been provided which may be collapsed upon itself or folded upon itself in an integral, strong, structurally intact manner for storage at the place of manufacture or for ease in transport (minimum space used in both cases), but still readily opened and then locked in use position when it has arrived at its place of use.

In order to provide a very strong, rigid corral structure when it is set up in position of FIGS. 1 and 2, it is necessary or at the very least highly preferred that there be provided a transverse floor member at the shopping cart inlet end of the corral. Many conventional shopping cart corrals have a flat beam or bar equivalent to member 6 of this disclosure rigidly fixed to the ground engaging ends 25*b* (23*b*) of top bar or beam member 25 (23) which bends downwardly to contact the ground and support the cart input end of the corral.

However, in the structure of the applicant, it must be kept in mind that the entire structure must be able to be folded or collapsed upon itself in the manner seen in FIG. 3 or the opposite thereof. Accordingly, this normally conventional beam 26 has additional structure and function. Specifically, the lower end portions of upper beams 23, 23*b* and 25, 25*b* are upwardly and inwardly hollowed to provide cylindrical passages therewithin extending upwardly several inches at least from the bottom of the said vertical leg portions. Additionally, the upward facing side of flat beam 26 has welded or otherwise fixedly attached thereto cylindrical peg or pin members 127 which are normally received in the said cylindrical recesses. While this is only shown in detail with peg or pin 27 received within cylindrical vertical passageway 28 in FIG. 1, lower right center, the same structure, identically, is employed at the outer lower end of beam/leg portion 23*b*.

With this structure the case, it can be seen that the end portions 23*b* and 25*b* can be pivoted with respect to the pins 27 in the passages 28 in the same manner that the U-frame and its parts may be pivoted with respect to the legs 22–25, inclusive when the sleeves 20 and 21 are raised to the position of FIG. 6.

When the device has been transported from its place of storage or manufacture to the place of use, it is desired to open up the frame from the position of FIG. 3 (or its opposite) to what is seen in FIGS. 1 and 2. Once this has been done, then, through openings (not seen) in the lower portions of legs 23*b* and 25*b*, say at about the point of the lead line from numeral 28, rivets are applied through the lower leg openings to engage pins or pegs 27 and rigidly fix them with respect to their hollow outside surrounding walls.

From the foregoing, it will be seen that this invention is well adapted to teach all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. An improved shopping cart corral comprising, in combination:

(1) a closed end structure for said corral comprising a substantially A-shaped frame member having (a) a pair of first and second, spaced apart, normally vertical, substantially parallel side legs, (b) a normally substantially horizontal upper beam rigidly connecting together the said side legs adjacent the tops thereof and (c) a normally substantially horizontal, intermediate height beam rigidly joining together said vertical side legs substantially intermediate the upper and lower ends thereof, (2) a first, elongate, side wall beam member connected at an inboard end thereof to a first one of said side legs intermediate the ends thereof and having connected thereto, at an outboard end thereof, a stub leg substantially vertical in at least a portion thereof supporting said first side wall member in a substantially horizontal position above the ground, (3) a second, elongate, side wall beam member connected at an inboard end thereof to a second one of said side legs intermediate the ends thereof and having connected thereto, at an outboard end thereof, a stub leg substantially vertical in at least a portion thereof supporting said second side wall member in a substantially horizontal position above the ground, (4) means connecting the inboard end of each respective side wall beam member to the respective vertical side wall leg in such manner as to enable the A-shaped frame member, under certain conditions, to pivot with respect to said side wall beam members in a manner so as to collapse itself and one of said side wall beam members essentially against the other side wall beam member, in substantially parallel position relative thereto, (5) said connecting means also connecting the inboard end of each respective side wall beam member to the respective vertical side leg in such manner as to be able to lock the inboard ends of said side wall members, under certain conditions, to the said respective vertical side leg and to the normally substantially horizontal intermediate height beam of said A-shaped frame member in such manner that the side wall members are fixed, substantially parallel to one another and, as well, fixed in extension at substantial right angles to the A-shaped frame member, each in the same direction.

2. A corral as in claim 1 wherein there are two normally substantially horizontal but vertically spaced apart first and second elongate side wall beam members on each side, such paired members on each side connected at their inboard ends to the respective normally vertical side leg and at their outer ends to the respective stub leg.

3. A corral as in claim 1 wherein the means connecting the inboard end of each respective side wall beam member to the respective vertical side leg comprises an elongate, normally vertical sleeve, the inboard ends of the respective side wall beam members being rigidly connected to each said sleeve.

4. A corral as in claim 2 wherein the means connecting the inboard end of each respective side wall beam member to the respective vertical side leg comprises an elongate, normally vertical sleeve, the inboard ends of the respective side wall beam members being rigidly connected to each said sleeve.

5. A corral as in claim 3 wherein each said sleeve on each said vertical side leg has a vertical slot in the lower end thereof positioned substantially 90° away from the point of connection of the inboard ends of the side wall beam members to said sleeves.

6. A corral as in claim 4 wherein each said sleeve on each said vertical side leg has a vertical slot in the lower end thereof positioned substantially 90° away from the point of connection of the inboard ends of the side wall beam members to said sleeves.

7. A corral as in claim 4 wherein the inboard ends of each respective pair of side wall beam members are connected adjacent the upper and lower ends of said respective sleeves.

8. An improved shopping cart corral comprising, in combination:

(1) a closed end structure for said corral comprising a substantially A-shaped frame member having (a) a pair of first and second, spaced apart, normally vertical, substantially parallel side legs, (b) a normally substantially horizontal upper beam rigidly connecting together the said side legs adjacent the tops thereof and (c) a normally substantially horizontal, intermediate height beam rigidly joining together said vertical side legs substantially intermediate the upper and lower ends thereof, (2) a first, elongate, side wall beam member connected at an inboard end thereof to a first one of said side legs intermediate the ends thereof and having connected thereto, at an outboard end thereof, a stub leg substantially vertical in at least a portion thereof and supporting said first side wall member in a substantially horizontal position above the ground, (3) a second, elongate, side wall beam member connected at an inboard end thereof to a second one of said side legs intermediate the ends thereof and having connected thereto, at an outboard end thereof, a stub leg substantially vertical in at least a portion thereof and supporting said second side wall member in a substantially horizontal position above the ground, (4) means connecting the inboard end of each respective side wall beam member to the respective vertical side wall leg in such manner as to enable the A-shaped frame member, under certain conditions, to pivot with respect to said side wall beam members in a manner so as to collapse itself and one of said side wall beam members essentially against the other side wall beam member, in substantially parallel position relative thereto, (5) said connecting means also connecting the inboard end of each respective side wall beam member to the respective vertical side leg in such manner as to be able to lock the inboard ends of said side wall members, under certain conditions, to the said respective vertical side leg and to the normally substantially horizontal intermediate height beam of said A-shape frame member in such manner that the side wall members are fixed substantially parallel to one another and, as well, fixed in extension at substantial right angles to the A-shape frame member, each in the same direction, (6) the means connecting the inboard end of each respective side wall beam member to the respective vertical side leg comprising an elongate, normally vertical sleeve, the inboard ends of the respective side wall beam members being rigidly connected to each said sleeve, (7) each said sleeve on each said vertical side leg having a vertical slot in the lower end thereof positioned substantially 90° away from the point of connection of the inboard ends of the side wall beam members to said sleeves.

9. A corral as in claim 8 wherein there are two normally substantially horizontal but vertically spaced apart first and second elongate side wall beam members on each side, such paired members on each side connected at their inboard ends to the respective normally vertical side leg and at their outer ends to the respective stub leg, the means connecting the inboard end of each respective side wall beam member to the respective vertical side leg comprising an elongate, normally vertical sleeve, the inboard ends of the respective side wall beam members being separately and rigidly connected to each said sleeve.

10. A corral as in claim 9 wherein the inboard ends of each respective pair of side wall beam members are connected adjacent the upper and lower ends of said respective sleeves.

* * * * *